US005562581A

United States Patent [19]

Roberto et al.

[11] Patent Number: 5,562,581

[45] Date of Patent: Oct. 8, 1996

[54] DEVICE FOR WITHDRAWING AND OPENING CASES MADE OF SHEET MATERIAL AND FOR FEEDING THEM TO A PACKAGING LINE

[75] Inventors: Tagliaferri Roberto, Castel S. Pietro; Marzocchi Paolo, Gallo Bolognese Di Castel S. Pietro, both of Italy

[73] Assignee: I.M.A. Industria Macchine Automatiche S.p.A., Ozzano Emilia, Italy

[21] Appl. No.: 392,091

[22] Filed: Feb. 22, 1995

[30] Foreign Application Priority Data

Feb. 24, 1994 [IT] Italy ..... BO94A0072

[51] Int. Cl.[6] ..... B31B 1/80

[52] U.S. Cl. ..... 493/310; 493/312; 493/317; 53/566; 53/579

[58] Field of Search ..... 493/310, 312, 493/313, 315, 316, 317; 53/566, 579

[56] References Cited

U.S. PATENT DOCUMENTS

| | | | |
|---|---|---|---|
| 2,671,385 | 3/1954 | Johenning et al. | 493/310 |
| 3,066,579 | 1/1962 | Brush . | |
| 3,599,541 | 8/1971 | Allen | 493/310 |
| 3,783,752 | 1/1974 | Langen et al. | 493/315 |
| 3,937,131 | 2/1976 | Kellogg | 493/310 |
| 4,211,153 | 7/1980 | Walter et al. | 493/310 |
| 4,331,436 | 5/1982 | Kuttenbaum et al. | 493/310 |
| 4,871,348 | 10/1989 | Konaka | 496/315 |
| 5,067,937 | 11/1991 | Aschaber et al. | 493/310 |
| 5,207,630 | 5/1993 | Decker et al. | 493/315 |

FOREIGN PATENT DOCUMENTS 756890 of 1956 United Kingdom .

OTHER PUBLICATIONS

The European Search Report dated Jun. 19, 1995.

*Primary Examiner*—Jack W. Lavinder
*Assistant Examiner*—Darren Ark Da
*Attorney, Agent, or Firm*—McAulay Fisher Nissen Goldberg & Kiel

[57] ABSTRACT

The device has a rotating member including pulleys that and joined to a belt conveyor along which flat folded cases advance. Suction cups are mounted on shafts situated along the periphery of the rotary member and a coaxial drum, rotating in synchrony with the pulleys, carries the shafts which are made to oscillate by crank means. The drum also supports rocking levers which are in engagement with a cam and cause cranks to rotate. Further suction cups, situated at the outlet of the feeding line, are moved in phase relation with the previous suction cups between a gripping position, in which the suction cups grip a flat folded case on opposite sides, and a position in which adjacent wall panels of the case are opened. Belt conveyors receive the opened case and trail it along a packaging line.

10 Claims, 5 Drawing Sheets

FIG. 3
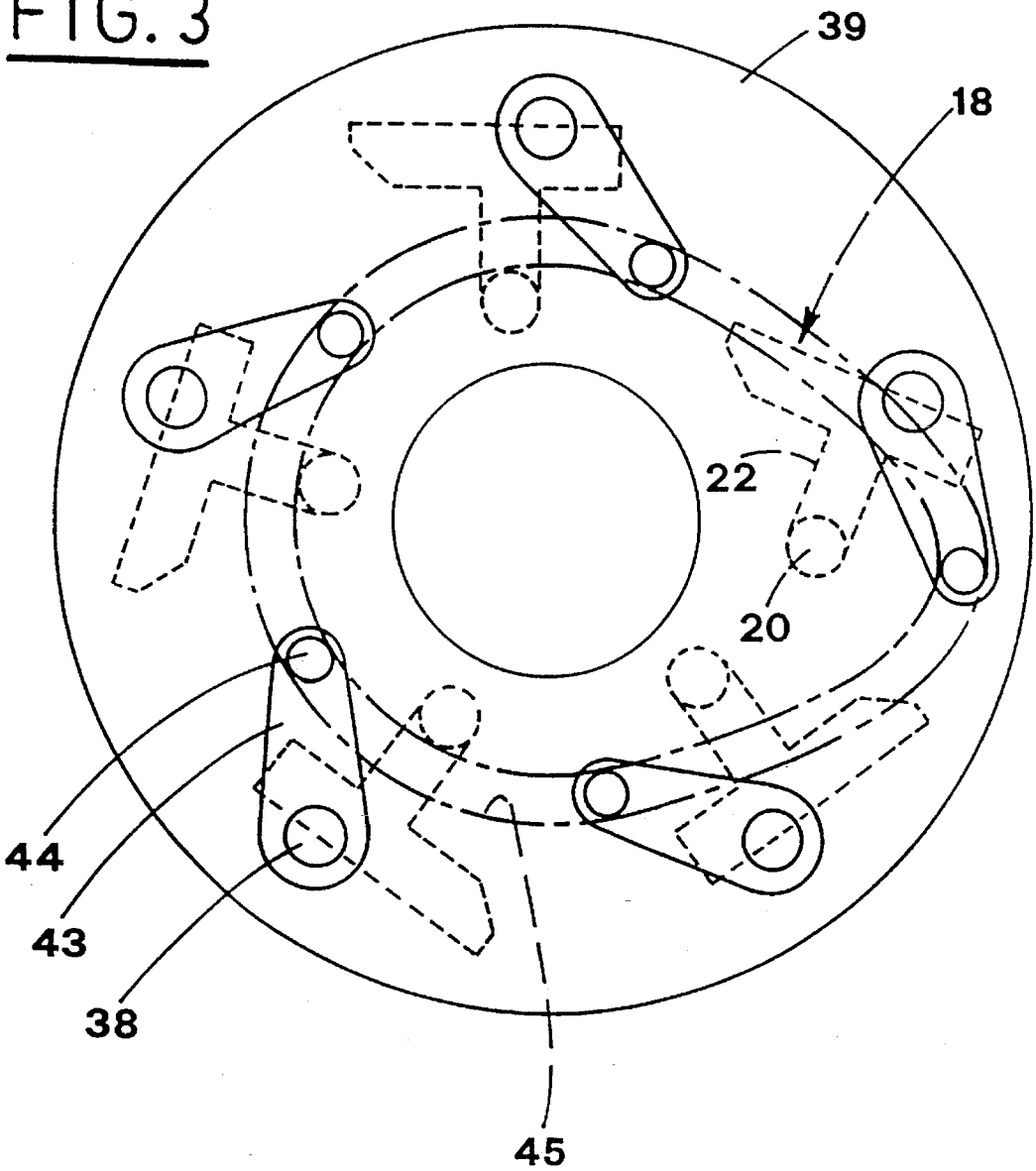
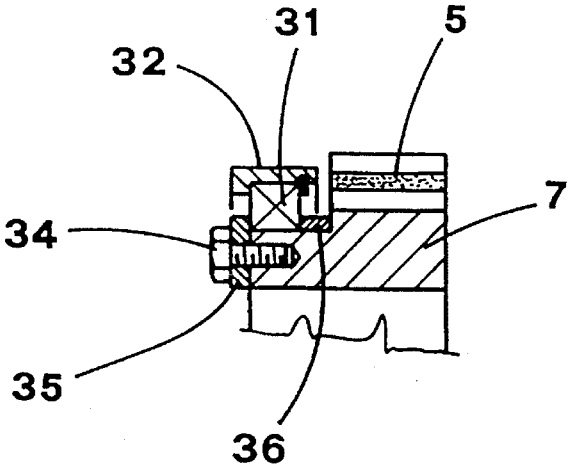
FIG. 4

DEVICE FOR WITHDRAWING AND OPENING CASES MADE OF SHEET MATERIAL AND FOR FEEDING THEM TO A PACKAGING LINE

BACKGROUND OF THE INVENTION

The present invention relates to withdrawing and setting up of cases obtained from sheet material and fed to a packaging line.

DESCRIPTION OF THE PRIOR ART

It is known that cases, made from blanks of semirigid sheet material, e.g. cardboard, are used for packaging various articles.

These cases are generally stored in flat folded condition in a special magazine, from which they are withdrawn one by one so as to be fed to the products packaging line.

At present, various devices are used for withdrawing, setting up and transferring the cases.

Some of these devices include a member rotating about a horizontal axis, transversal to the packaging line and carrying, along its periphery, a plurality of gripping means.

The gripping means, formed by e.g. suction cups, withdraw the cases and feed them to the packaging line.

While being fed to the packaging line, the blanks are set up to the final configuration by stationary or movable strikers.

During the opening step, the adjacent edges are often opened wider than 90 degrees, so that the material is suitably yielded.

However, the above mentioned devices have some disadvantages that reduce their performance.

In particular, it has been reported that during the case opening step, the gripping means can damage the case so that the package integrity is jeopardised.

Moreover, feeding of the opened blanks to the packaging line is helped by special means that facilitate their introduction between the correspondent trailing and holding means of the packaging line.

Another device featuring a rotating member is disclosed in U.S. Pat. No. 4.194.442.

First gripping means of this device are guided along an arm that swings on a plane to the axis of the rotating member.

The arm carries a planetary gear with a pin that engages a radial cam integral with the rotating member and meshing with a toothed sector concentric and integral with the rotating member.

The radial cam is so shaped that the swing motion of the arm is advanced when approaching the blank magazine and stopped in the gripping position.

Further cams of the rotating member, engaged by a pin of the gripping means, move these gripping means from a far from the magazine to a close thereto position so as to withdraw the blanks therefrom.

Opening of the blank, during the conveying, is helped by second gripping means carried by the rotating member and acting on an wall panel of the blank adjacent to the wall panel engaged by the first gripping means.

Due to the combined action of these gripping means, the blank is opened and subsequently fed to the packaging line.

Also this technical solution presents some drawbacks, among which the main are:

- second gripping means (comprising at least one suction cup) movement does not cause rotation of the related blank wall panel with respect to the corner common to the two wall panels gripped by the second and first gripping means; this is particularly emphasised for reduced height containers (cases);
- in order to change the blank size it is necessary to substitute some elements;
- maximum angle between the two wall panels during blank opening is little more than 90 degrees.

SUMMARY OF THE INVENTION

The object of the present invention is to provide a device that receives flat folded tubular blanks directly from the feeding line, sets the blanks up and subsequently, introduces them gently between the trailing and holding means of the erected cases packaging line, the whole without damaging the cases.

Another object of the present invention is to provide a device that cooperates with the folded blanks trailing means of the feeding line and with the trailing and holding means of the packaging line.

Yet a further object of the invention is to provide a device that, in addition to the above mentioned features, can be also used with blanks of various sizes.

The above mentioned objects are obtained, in accordance with the invention, by means of a device for withdrawing cases made of sheet material, for opening said cases and feeding them to a packaging line, said device including:

- first belt conveyor means for conveying said cases, withdrawn in flat folded condition, along a feeding line;
- a rotary member including pulleys connected to said first belt conveyor means and driven so as to rotate continuously about a horizontal axis transverse to said feeding line;
- first gripping means including suction cups, situated along the periphery of said rotary member and mounted on shafts supported by a rotary drum in such a manner that they can oscillate under the action of crank means which rotate about respective axes, said rotary drum and said pulleys being coaxial and driven in synchrony with one another;
- an operating device equipped with cam means in engagement with rocking means supported by said drum for causing rotation of said crank means of said shafts;
- second gripping means including suction cups and located at the outlet of said feeding line, over said rotary member, said second gripping means being operated in phase relation with said first gripping means to move from a gripping position, in which said suction cups of said first gripping means and said suction cups of said second gripping means grip at opposed sides a flat folded case, and an opening position in which adjacent wall panels of said case are opened by moving said suction cups of said first gripping means;
- a yielding roller, idling about an axis parallel to the axis of said rotary member and aimed at striking a fore corner of each case being opened and to overfold backwards a related wall panel of said case;
- second belt conveyor means for taking over said cases when already opened and for carrying them along a packaging line.

BRIEF DESCRIPTION OF THE DRAWINGS

The characteristic features of the present invention are pointed out in the following description with reference to the enclosed drawings, in which:

FIG. 3 shows a sectional view of means that operate the subject device, taken along line III—III of FIG. 1;

FIG. 4 shows an enlarged sectional view of a particular of the device, taken along line IV—IV of FIG. 2*b*.

DESCRIPTION OF THE PREFERRED EMBODIMENT

Figure 1:
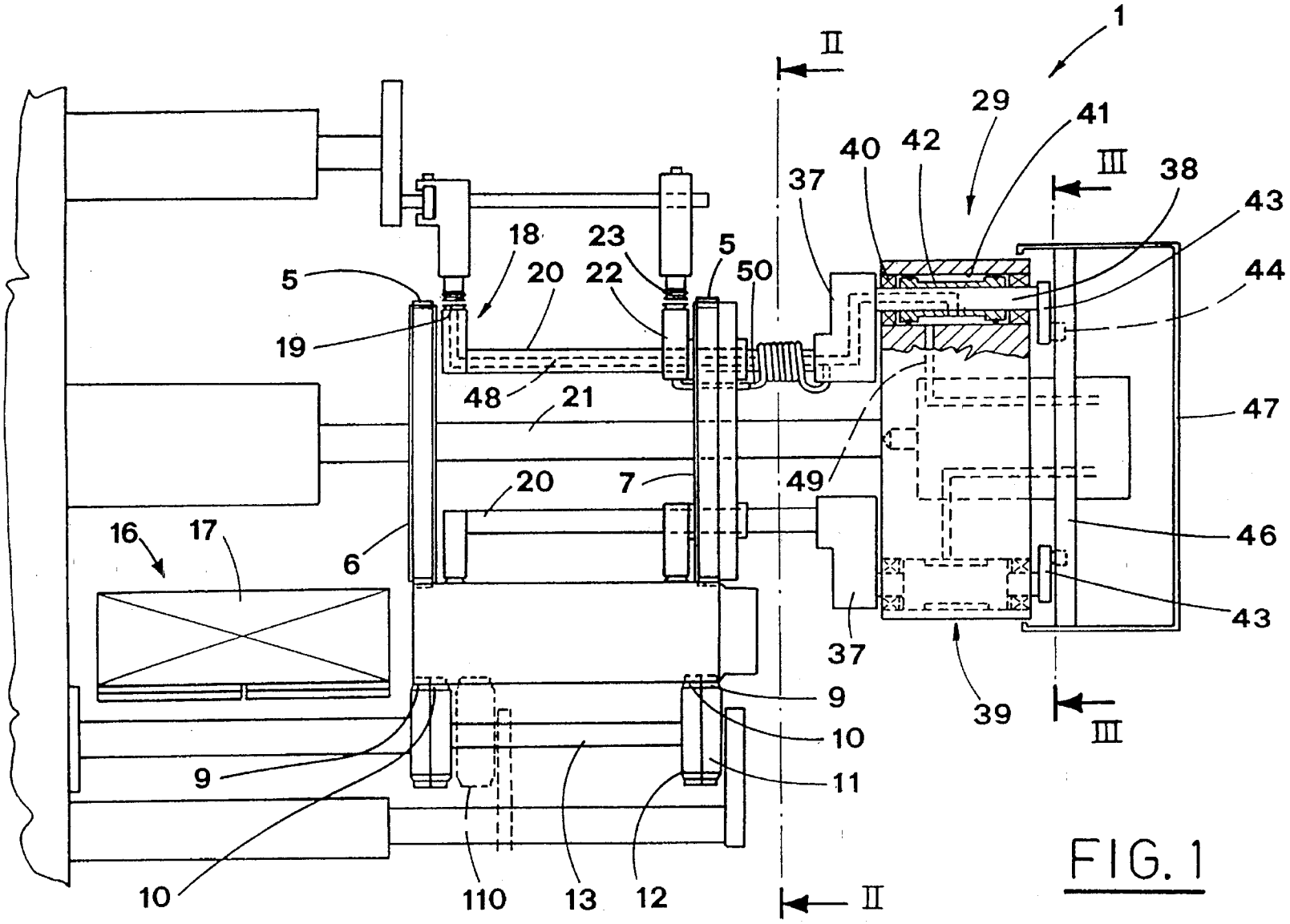
FIG. 1 shows a cross sectional view of the device subject of the present invention.

With reference to the above mentioned figures, reference numeral 1 indicates a device that opens flat folded blanks 2 made of sheet material.

The blanks 2 are withdrawn from a suitable magazine, not shown (e.g. of the type described by the Italian patent application no. BO94A 000049 of the same Applicant), and advanced along a feeding line 3.

Opened cases, i.e. erected blanks are transferred to a packaging line 4 situated below the feeding line 3 and parallel thereto.

The feeding line 3 includes a pair of toothed belts 5, arranged side by side and trained around two pulleys 6, 7 of the device 1 (FIG. 1).

On their outer surfaces, the toothed belts 5 have a plurality of lugs 8, regularly spaced apart and aimed at withdrawing and trailing flattened cases 2 to be opened and transferred to the packaging line 4.

The packaging line 4 includes a double pair of toothed belts 9, 10 mounted on respective coaxial pulleys 11, 12 which are keyed onto a shaft 13 (see FIG. 1).

On their outer surfaces, the belts 9, 10 have a plurality of lugs 14,15, regularly spaced apart, that act as fore and rear stops for the erected cases 2 to be carried along the line 4.

More precisely, the lugs 14 of the belts 9 placed at the sides of the line 4, act as rear stops, while the lugs 15 of the belts 10, inner with respect to the former, act as fore stops for the cases 2.

Therefore, the distance between the couples of lugs 14, 15 defines the containing space for the cases to be packaged.

This distance can be changed in accordance with different sizes of the cases to be packaged, by changing the angular position of the inner pulleys 12 with respect to the outer pulleys 11.

It is also possible to change the distance between the two pairs of belts 9, 10, in accordance with the longitudinal dimensions of the cases 2, by moving the pair of pulleys 11, 12 along the shaft 13, as indicated by broken line 110 in FIG. 1.

Likewise, the distance between the belts 5 of the feeding line 3 can be changed by varying the distance between the pulleys 6, 7.

The lower run of the belts 5 acts on the top of the cases 2 and cooperates with the upper runs of the belts 9, 10 of packaging line 4, so as to hold the cases 2.

A line 16 for feeding articles 17 to be packaged is placed, in a known way, at the side of the packaging line 4 (FIG. 1).

The cases 2 are withdrawn and opened by a plurality of gripping means 18 which include suction cups, designed to grip one wall panel of each flat folded cases 2 advancing along the feeding line 3.

The gripping means 18, equipped respectively with a pair of suction cups 19, are mounted in pairs on respective shafts 20 parallel to the axis of the driving shaft 21 of the pulleys 6, 7, and angularly equispaced with respect to one another.

The pairs of suction cups 19 are carried by respective arms 22 that extend radially from the shafts 20 adjacent to the pulleys 6, 7.

In particular, the arms 22 situated close to the ends of the shafts 20 and to the pulley 6 are fixedly joined to the shafts 20, while the other arms 22 is slidingly bound to the shafts 20 by known means, which are not shown, so that they can rotate therewith.

The arms 22 are axially moved in synchrony with the adjacent pulley 7.

Figure 2A:
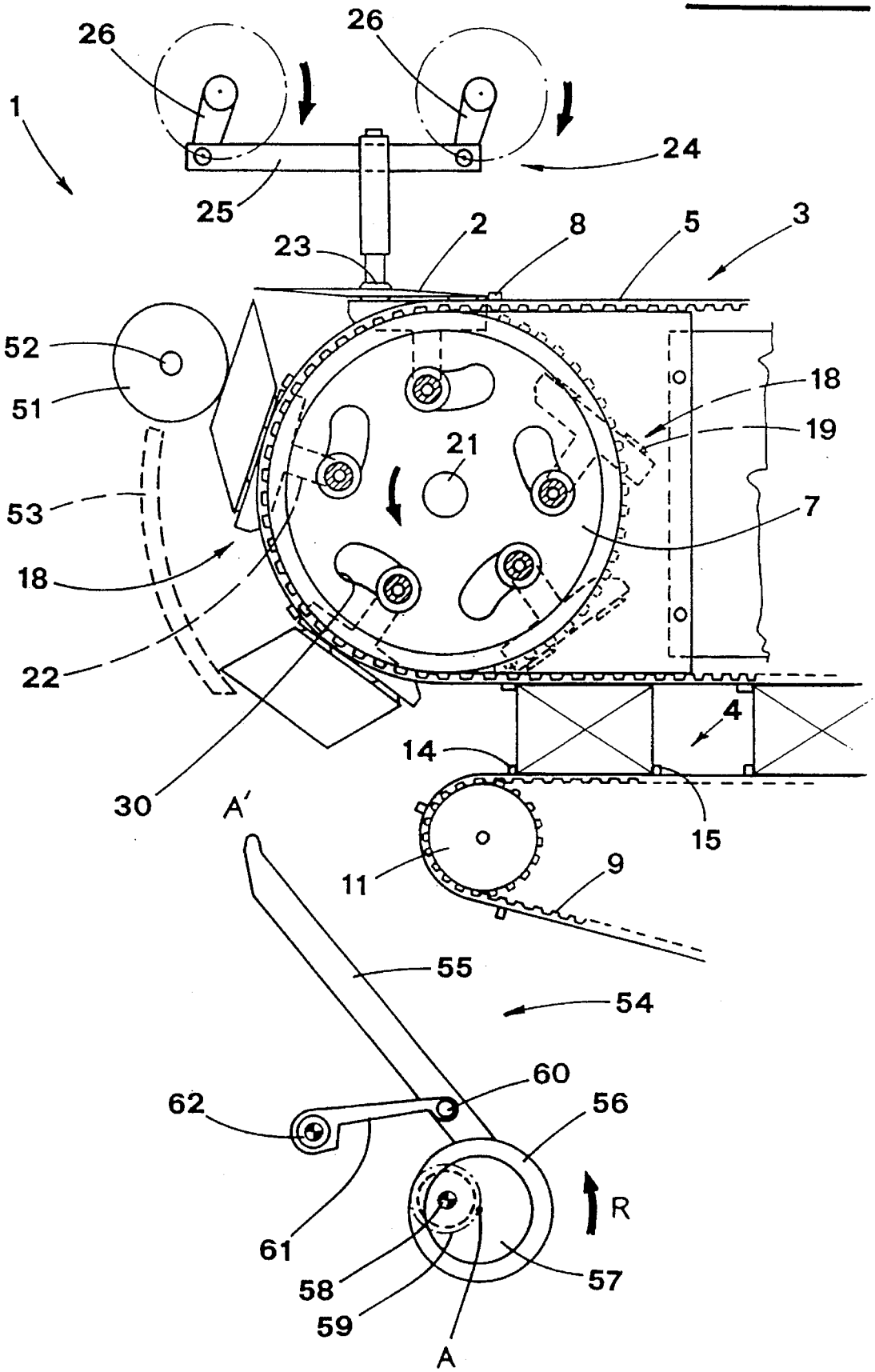
FIG. 2*a* shows a sectional view taken along line II—II of FIG. 1.

In a working position, the suction cups 19 of the gripping means 18 face a pair of suction cups 23, driven by a crank mechanism 24 situated substantially at the outlet of the cases 2 from the line 3, over the pulleys 6, 7 (FIG. 2*a*).

The crank mechanism features a supporting bar 25 for each suction cup 23, having opposite sides articulated to two cranks 26 which rotate about axes parallel to the axis of the driving shaft 21.

Figure 2B:
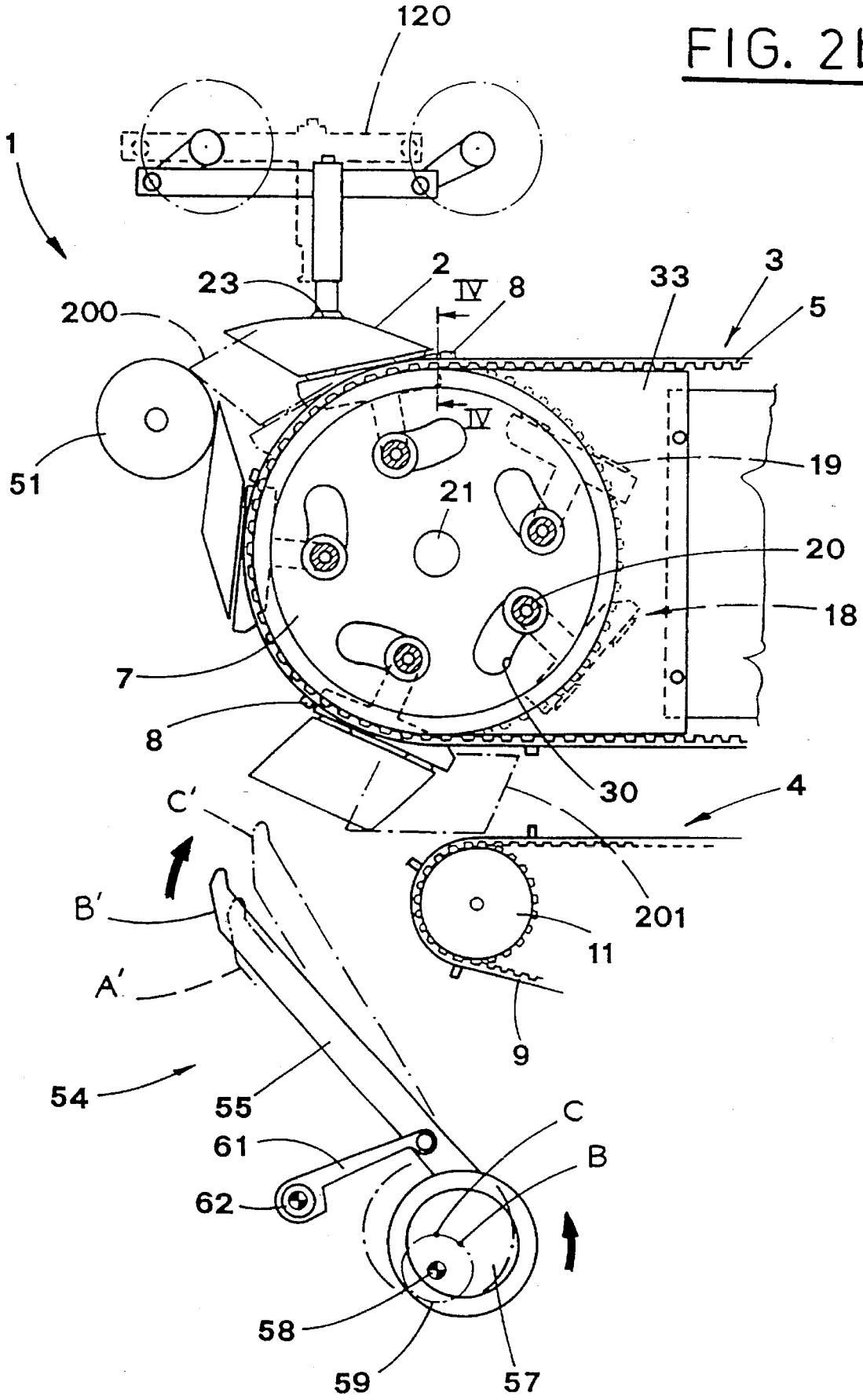
FIGS. 2*b*, 2*c* and 2*d* show the same view as FIG. 2*a*, or a part of this view, in various working steps.

Therefore, the bar 25 moves on a longitudinal plane, maintaining its horizontal attitude, as broken line 120 shows in FIG. 2*b*.

The shafts 20 of the suction cups 19 protrude from the pulley 7 and are operated by a device 29 acting on related ends of the shafts (FIG. 1).

The pulley 7 has arc-like slots 30 through which the shafts 20 pass, the convexity of the slots facing the centre of the pulley (FIG. 2*b*).

As better seen in the enlarged particular in FIG. 4, a ring-like protrusion 32 made on a surface of a plate 33 fixed to the frame of the device (FIG. 2*b*), supports rotatably the pulley 7, in such a manner that it can rotate by means of a rolling bearing 31.

The pulley is fastened, by a screw 34, to a ring 35, and the bearing 31 is clamped between the ring 35 and a spacer 36 (FIG. 4).

The shafts 20 are carried, in such a manner that they can oscillate, by respective cranks 37 bound transversally to respective pins 38 (FIG. 3).

The rotating pins 38 are carried by a drum 39 of the operating device 29 mounted in cantilevered fashion on the driving shaft 21 (FIG. 1).

In particular, the pins 38 are supported by rolling bearings 40 in such a way that they pass through cross holes 41 made along the periphery of the drum 39 and regularly spaced apart from one another.

Sleeves 42 are mounted on the pins 38 and feature suitable elastic seals that make a tight seal on the inner surface of the holes 41.

Rocking levers 43 are integral with the pins 38 at the side opposite to the crank 37.

The rocking levers 43 carry idling rollers 44 that run in a ring-like cam 45 made on a surface of a plate 46 integral with the frame (FIG. 3).

On the side turned outward, the plate 46 is covered by a protective case 47.

Known suction means, aimed at operating the suction cups 19 by special ducts, are connected to the operating device 29.

In particular, the suction cups 19, located close to the pulley 6, communicate with a duct 48 made along the shafts 20, arms 22, cranks 37 and pins 38.

This duct 48 opens in the holes 41 of the drum 39 that communicate with ducts 49 of the drum 39, connected with the above mentioned suction means (FIG. 1).

The suction cups situated close to the pulley 7 are instead connected with flexible pipes 50 in communication with the ducts 48.

Downstream of the section of the device in which the cases 2 are gripped by the suction cups 19, there is at least one roller 51 rotating about an axis 52 and aimed at improving opening of the cases 2 (FIG. 2*a*).

In fact, the roller 51 strikes a fore corner of the cases being opened, so as to fold backwards the related wall panel and subsequently yield the case, as will be described in detail in the following.

Position of the roller 51 can be suitably adjusted in accordance with the dimensions of the cases to be opened.

An arc-like striker 53 can be located downstream of the yielding roller 51 and at a side of the rotating member with the pulleys 6, 7, in a position that can be adjusted (FIG. 2*a*).

The task of the striker 53 is to prevent the case 2 from returning to the nearly flat folded position because of elastic reaction of the sheet material.

Alternately, the only yielding roller 51 is provided, situated suitably near the zone of feeding the cases 2 to the packaging line 4.

The device 1 has also a pushing member 54 supplied with a blade 55 aimed at pushing the cases 2 from the back in the step of feeding to the packaging line 4.

A pusher blade 55 extends from a ring-like head 56 mounted, in such a way that it can rotate, on an eccentric member 57 integral with the driving shaft 58.

Line 59 indicates the path of the centre A of the eccentric member 57 that moves when the driving shaft 58 rotates (FIG. 2*a*).

A connection rod 61 pivoted to the fixed frame by means of a gudgeon 62 is articulated to the pusher blade 55.

The shaft 58 and the gudgeon 62 have the axis horizontal and transverse to the packaging line 4, so that the pusher blade 55 oscillates, as shown in the following, on a vertical plane, longitudinal to the packaging line 4.

Operation of the described device is now explained, beginning after that the flat folded case 2 has been withdrawn from the magazine.

The case 2, trailed by a pair of lugs 8, is conveyed by the belts 5, up to the top of the rotating member constituted by the pulleys 6, 7.

At the top of the pulleys 6, 7, the bottom of the flattened case 2 is gripped by pairs of suction cups 19 of the gripping means 18, as seen in FIG. 2*a*.

The case 2 is held by the suction cups 19, suitably activated, that transfer it to the packaging line 4 below. During the transferring step, the case 2 is opened.

It will be noted that during the transferring step the suction cups 19 are situated on a plane substantially tangential to the rotating member with pulleys 6, 7.

In order to facilitate the gripping of the case 2 to be transferred, the arms 22 carrying the suction cups 19 are rotated around respective pins 38 so as to incline the suction cups 19 toward the feeding line 3 (FIG. 2*b*).

Therefore, the arms 22 move progressively in opposite direction, so as to cause the suction cups 19 to lap, on a tangential plane, the flat folded cases fed along the feeding line 3.

The arms 22 are rotated by the rocking levers 43 that engage the fixed cam 45 during rotation of the device 29 (FIG. 3).

At the same time, the cases 2 are gripped at the other side by other suction cups 23 driven by the crank mechanism 24.

As a result of the rotation of the member with pulleys 6, 7 and of the operation of the crank mechanism 24, the suction cups 19, 23 move ones with respect to others so that the adjacent wall panels of the case 2 are opened (See FIG. 2*b*).

The case 2, partially erected, is released by the suction cups 23 by stopping their suction action.

Opening of the case 2 is completed by the roller 51 that also helps the case 2 to engage the striker 53, if present.

As seen in FIG. 2*b*, the roller 51 strikes the fore corner of the case 2 held by the suction cups 19; for the sake of clarity, the case has been indicated with broken line 200.

Therefore, the roller 51 folds backwards the related fore wall panel of the case 2 causing its yielding up to almost 180 degrees with respect to the flat folded position.

As a result, the blank does not return elastically to the almost flat folded position, after it has been released by the suction cups 23.

When located at the bottom of the pulleys 6,7, the suction cups 19 are placed on a plane longitudinal to the packaging line 4.

The pusher blade 55, operated in suitable phase relation with introduction of the blank between the upper belts 5 and the lower belts 9, 10 of the packaging line 4, acts on the back of the case 2.

More precisely, the driving shaft 58 while rotating in the direction indicated by arrow R, causes rotation of the eccentric member 57, whose centre follows the path 59.

The blade 55 takes the position A' when the centre of the eccentric member 57 is in the point A of the trajectory 59 (FIG. 2*a*).

Rotation of the eccentric member 57 causes oscillation of the pusher blade 55, as seen in FIG. 2*b*, where B' and C' indicate the positions of the blade 55 which correspond with the positions B and C of the eccentric member 57 along the path 59, beginning from the position A' of the blade.

Figure 2D:
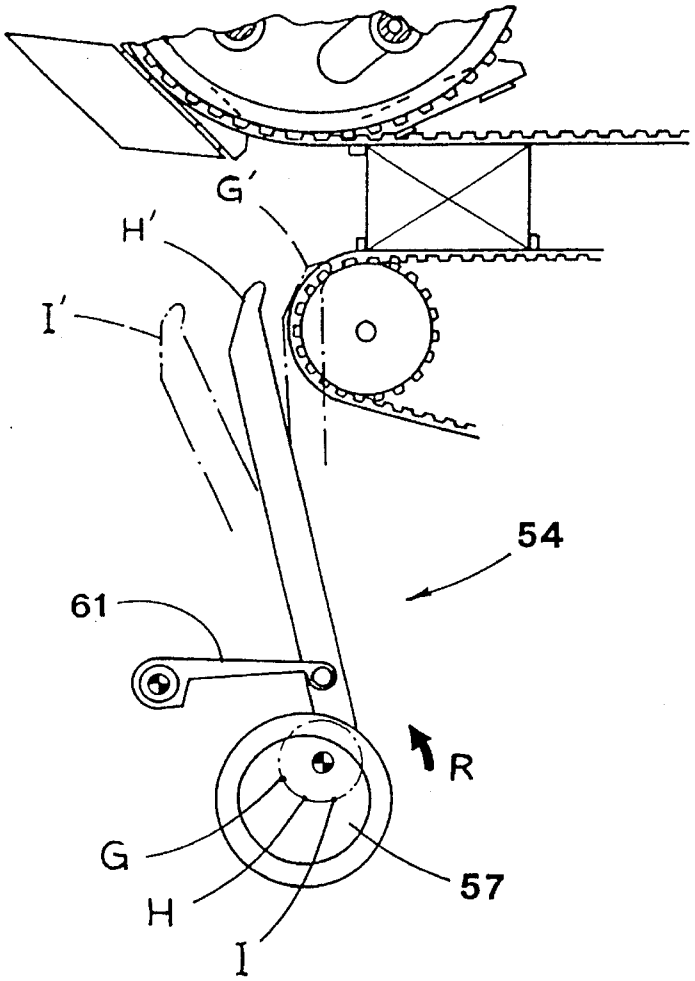
Figure 2C:
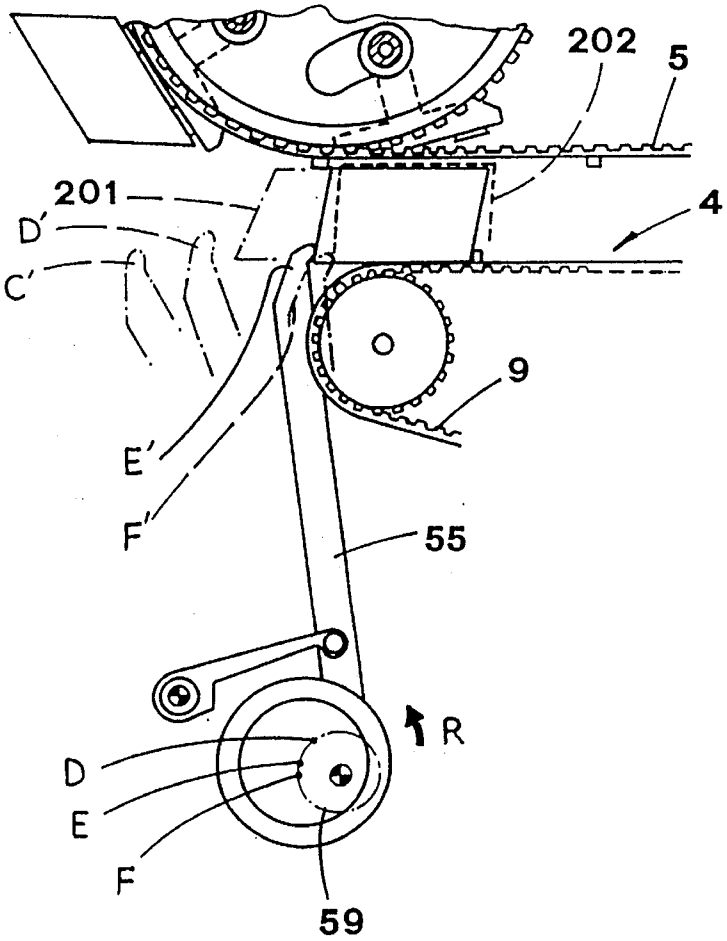

Oscillation of the blade 55 follows the arcuated path, as seen from the positions D', E' and F' of FIG. 2*c* corresponding with the positions D, E and F of the eccentric member 57 along the path 59.

In this step the case, partially inserted between the upper belts 5 and the lower belts 9, 10 of the packaging line 4, is pushed by the pusher blade 55.

The pusher blade position at the beginning of pushing is indicated by broken line 201.

In fact, the blade 55 pushes the rear surface of the case, so that the case erects completely becoming perfectly parallelepidal, as schematically indicated by broken line 202 in FIG. 2*c*.

Afterwards, the pusher blade 55 leaves the case 2 and goes back as shown by G', H' and I' in FIG. 2*d*, corresponding to the positions G, H and I assumed by the eccentric member 57 along the path 59.

Consequently, the opened case is gently inserted between the upper belts 5 and the lower belts 9, 10 operated in phase relation so as to receive the same case 2 within the lugs 14, 15.

The case is held by the lugs 14, 15 of the belts 9, 10 and the lugs 8 of the upper belts 5 and is conveyed along the packaging line 4(FIG. 2*a*).

After the opened case has been inserted between the belts 5 and 9, 10, the suction cups 19 are detached from it.

The described device allows for the best picking up and feeding of the cases 2 to the packaging line 4, assuring perfect case opening, without damages to the same case.

The case is opened automatically, after having been picked up from the feeding line, by the same suction cups that withdraw it.

This also assures perfect positioning of the cases during the opening step, that allows to work with high speed so as to increase productivity.

It is to be pointed out that the device is easily adjustable, that allows for handling cases of different forms and sizes, according to the needs.

This is particularly advantageous in comparison with the known devices on which parts must be replaced in order to change the case size.

It is also to be stressed that the same device transfers the case already opened directly to the packaging line 4, without reducing operation speed and throughput.

The proposed device works perfectly and independently from the cases' size, without the drawbacks, reported in the introduction, occurring during opening of the cases' of reduced height.

The device also yields the wall panels of the blank opening them up to almost 180 degrees, with all the advantages that this feature brings about.

It is understood that what above has been described as a mere, not limitative example, therefore all possible constructive variants are protected by the present technical solution, as described above and claimed in the following.

What is claim is:

1. A device for withdrawing cases made of sheet material, for opening said cases and feeding them to a packaging line, said device including:

first belt conveyor means for conveying said cases, withdrawn in flat folded condition, along a feeding line;

a rotary member including pulleys connected to said first belt conveyor means and driven so as to rotate continuously about a horizontal axis transverse to said feeding line;

first gripping means including suction cups, situated along a periphery of said rotary member and mounted on shafts supported by a rotary drum in such a manner that they can oscillate under the action of crank means which rotate about respective axes, said rotary drum and said pulleys being coaxial and driven in synchrony with one another;

an operating device equipped with cam means in engagement with rocking means supported by said drum for causing rotation of said crank means of said shafts;

second gripping means including suction cups and located at the outlet of said feeding line, over said rotary member, said second gripping means being operated in phase relation with said first gripping means to move from a gripping position, in which said suction cups of said first gripping means and said suction cups of said second gripping means grip at opposed sides a flat folded case, and an opening position in which adjacent wall panels of said case are opened by moving said suction cups of said first gripping means;

a yielding roller, idling about an axis parallel to the axis of said rotary member and aimed at striking a fore corner of each case being opened and to overfold backwards a related wall panel of said case;

second belt conveyor means for taking over said cases when already opened and for carrying them along a packaging line.

2. A device according to claim 1, wherein a pusher featuring a blade is aimed at pushing said cases on a back while they are fed to said packaging line.

3. A device according to claim 2, wherein said blade extends from a head rotatably mounted on an eccentric member rotated by a driving shaft, and has a connecting rod articulated thereto and pivoted on a stationary gudgeon, so that said blade oscillates on a vertical plane longitudinal to said packaging line.

4. A device according to claim 1, wherein downstream of the said yielding roller there is an arc-like striker situated at a side of said rotary member and aimed at guiding said cases so as to prevent them from returning to a flat position because of elastic reaction.

5. A device according to claim 1, wherein said second gripping means, including suction cups, are moved by a crank mechanism situated at a case outlet of said feeding line, over said pulleys of said rotary member, said second gripping means also including at least one supporting bar for said suction cups, said supporting bar being bound to two cranks rotating around axes parallel to said axis of said rotary member, so that said supporting bar is moved on a longitudinal plane maintaining its horizontal attitude.

6. A device according to claim 1, wherein a plurality of gripping means equipped with suction cups, are mounted on pairs of respective shafts angularly spaced apart on circumferences concentric to said axis of said rotary member with pulleys, said gripping means being carried by respective arms extending radially from the shafts close to the pulleys of said rotary member.

7. A device according to claim 1, wherein said drum is supported in cantilevered fashion by said rotary member with pulleys and features cross holes, spaced apart along its periphery, through which respective pins pass, said pins being integral at one end with said crank means for driving said shafts, and at a remainder end with said rocking means supporting idling rollers running in a stationary annular cam.

8. A device according to claim 1, wherein a pulley of said rotary member with pulleys, closer to said operating device, features arc-like slots through which said shafts pass, and is supported by means of a rolling bearing and an annular protrusion extending from a face of a plate provided with holes and fastened to a stationary frame of the device.

9. A device according to claim 1, wherein said packaging line includes two pairs of belts trained around respective coaxial pulleys and equipped, on outer surfaces thereof, with a plurality of lugs regularly spaced apart, said lugs acting as front and rear stops for said cases already opened and being conveyed along said packaging line, the distance between pairs of said lugs being adjusted by changing the angular displacement between said pulleys of said pairs of belts.

10. A device according to claim 1, wherein a lower run of said first belt conveyor means cooperates with said second belt conveyor means of said packaging line and acts on top of each case, said first and second belt conveyor means being equipped on outer surfaces with a plurality of lugs which hold said cases.

* * * * *